US006341463B1

(12) United States Patent
Dickey et al.

(10) Patent No.: US 6,341,463 B1
(45) Date of Patent: Jan. 29, 2002

(54) SIDING PANEL

(75) Inventors: Eric B. Dickey, Gladstone; L. F. Huebner, Liberty, both of MO (US)

(73) Assignee: Variform, Inc., Kearney, MO (US)

( * ) Notice: Subject to any disclaimer, the term of this patent is extended or adjusted under 35 U.S.C. 154(b) by 0 days.

(21) Appl. No.: 09/420,448

(22) Filed: Oct. 18, 1999

(51) Int. Cl.[7] ..... E04C 2/30; E04F 13/08
(52) U.S. Cl. ..... 52/521; 52/531
(58) Field of Search ..... 52/521, 529, 530, 52/531, 524, 525, 540

(56) References Cited

U.S. PATENT DOCUMENTS

| | | | | |
|---|---|---|---|---|
| 2,258,247 A | | 10/1941 | Hull | 189/86 |
| 2,739,676 A | * | 3/1956 | Tomiya | 52/521 |
| 3,161,924 A | | 12/1964 | Noecker | 20/57.5 |
| 3,325,952 A | * | 6/1967 | Yrachtenberg | 52/521 |
| 3,552,078 A | * | 1/1971 | Mayyes | 52/531 |
| 4,122,643 A | | 10/1978 | Hafner | 52/520 |
| 5,465,543 A | | 11/1995 | Seifert | 52/309 |
| 5,475,963 A | | 12/1995 | Chelednik | 52/545 |
| 5,490,359 A | | 2/1996 | Hepler | 52/506.06 |
| 5,768,844 A | | 6/1998 | Grace, Sr. et al. | 52/529 |
| 5,878,543 A | * | 3/1999 | Mowery | 52/529 |

FOREIGN PATENT DOCUMENTS

| | | |
|---|---|---|
| FR | 2015134 | 4/1970 |

OTHER PUBLICATIONS

*Royal Building Products*, Royal Building Products, Spring 1999 Issue.

* cited by examiner

*Primary Examiner*—Michael Safavi
(74) *Attorney, Agent, or Firm*—Lathrop & Gage L.C.

(57) ABSTRACT

A siding panel is provided having a front side and a rear side. The siding panel includes a nail hem for securing the siding panel to a support structure. The nail hem has a proximal member for mounting adjacent to the supports structure and a distal member spaced from the proximal member and the support structure. The distal member terminates in a free end. The siding panel further includes a catch projecting outwardly from the panel. The catch forming an impediment for the free end of the distal member thereby preventing further outward movement of the free end of the distal member.

11 Claims, 1 Drawing Sheet

SIDING PANEL

BACKGROUND OF THE INVENTION

1. Field of the Invention

The present invention relates generally to siding panels and more particularly, a siding panel having a latched nail hem for securing the siding to a structure.

2. Description of the Related Art

Vinyl or metal siding is increasingly used as a convenient and relatively inexpensive covering for residential and commercial buildings. Generally, siding is formed with a nailing strip, or single-ply nail hem, having preformed apertures for accepting a mounting nail or the like at the top of each section of siding to fasten the siding to the structure. A problem with the use of a single-ply nailing strip is that during the manufacture of the siding, edge portions of the siding tend to thin by tapering downwardly. Over time, repeated exposure to wind load may cause the mounting nail to tear through this thin portion of siding at the aperture, resulting in damage to the siding and, possibly, to the structure. Further, this thinning of the siding at the single-ply nail strip may also cause the aperture to weaken and thus stretch, which results in the siding pulling out over the mounting nail.

Another concern with single-ply nail hems is problems resulting form improper installation. Specifically, installing the mounting nails such that the nails are tight against the siding causes the siding panel to buckle with changes in temperature.

In an effort to remedy this problem, siding has been formed with a double-ply nail strip, i.e. a nail hem, by folding the nailing strip over on itself, as shown in FIG. 1, and ending in a free end. In the more effective double-ply nail hems, the free end extends downwardly a considerable extent and apertures are provided in both plies of the nail hem. As the siding is mounted to the structure, the fasteners extend through both nail plies. The double-ply nail hem is formed such that each ply is separated by a small span, and the fasteners, when properly installed, are not completely sunk, thus maintaining the span gap between the two plies of the nail hem. The siding is thereby allowed to glide the span between the two plies of the nail hem to compensate for the effect of wind, without the siding tearing through the fasteners.

The double-ply nail hem offers a dramatic increase in wind-load resistance. However, the concern of tight nailing still exists, which affects the panels ability to expand and contract. Further, the curl of the nail hem is susceptible to stress relaxation, which causes the outer ply to move outwardly and exert pressure against the fasteners and hindering the proper expansion and contraction of the panel. Further, there is limited control for the curl spacing during manufacture. The imprecise control over the span between the laminae lessens its effectiveness to withstand wind load and more specifically lessens the panel's ability to expand and contract due to temperature changes.

Thus, a need exists for a siding panel having a nail hem that is effective against stress relaxation and improper placement of fasteners.

SUMMARY OF THE INVENTION

It is an object of the present invention to provide a siding panel that withstands the stresses due to stress relaxation. It is further an object of the present invention to provide a siding panel that withstands extreme wind load applications, without comprising the panels ability to expand and contract in reaction to temperature change.

The siding panel of the present invention solves the problems identified in the related art. The siding panel hereof is preferably formed as an elongated panel having a front side and a rear side. The siding panel comprises a nail hem for securing the siding panel to a support structure. The nail hem includes a proximal laminae for mounting adjacent to the support structure and a distal laminae spaced from the proximal laminae and the support structure. The distal laminae terminates in a free end. The siding panel further includes a catch projecting outwardly from the panel. The catch serves as an impediment for the free end of the distal laminae thereby preventing further outward movement of the free end of the distal laminae

BRIEF DESCRIPTION OF THE DRAWINGS

The preferred embodiment of the present invention is further described in connection with the accompanying drawings, in which.

DETAILED DESCRIPTION OF THE INVENTION

Reference will now be made in detail to the preferred embodiment of the present invention, an example of which is illustrated in the accompanying figures. Whenever possible, the same reference numbers will be used throughout the description and figures to refer to the same or like parts.

Figure 2:
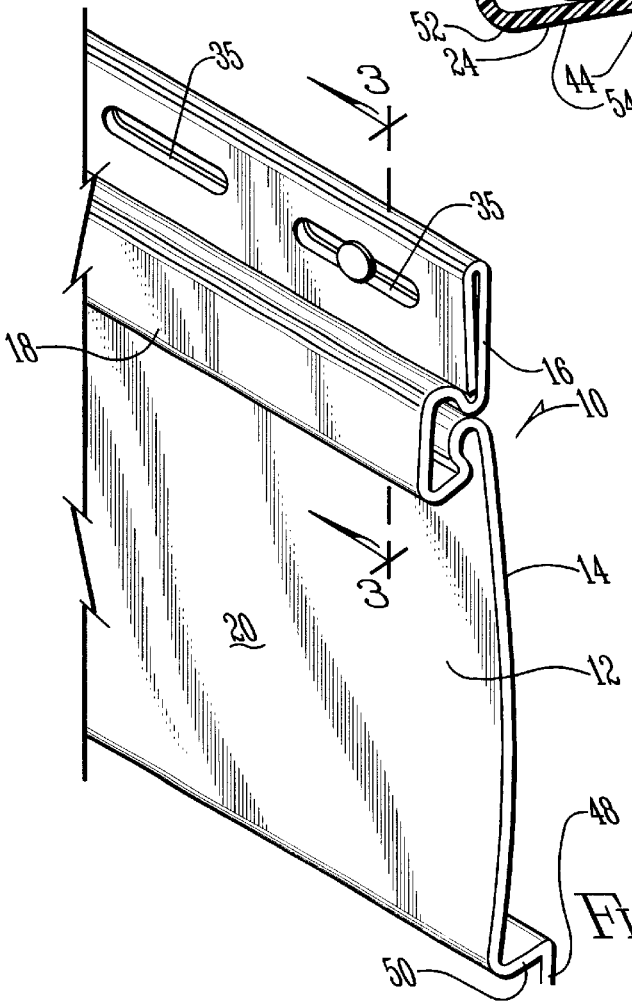
FIG. 2 is a perspective view of the side panel in accordance with the present invention.

Referring now to the drawings, a siding panel 10 in accordance with the present invention is preferably manufactured as a single elongated article from a unitary sheet of synthetic resin such as polyvinyl chloride. As shown in FIG. 2, the panel presents a front side 12, which may be embossed with a pattern such as simulated wood grain, and a back side 14, which typically lacks such embossing and is meant to be mounted adjacent to the structure. Broadly, the panel presents a double-ply nail hem 16, a receiver 18, at least one stretch 20, and a base 24 having a projection 26. The panel 10 hereof is described in its typical generally horizontal orientation as shown in FIG. 2, but may also be oriented vertically or at other angles as desired.

The double-ply nail hem 16 is positioned uppermost on the panel 10 and includes a proximal member 28, a distal member 30 and a curl 32. As the panel 10 is mounted to the structure, the proximal member 28 abuts the structure and includes a substantially flat span extending downwardly from the curl 32 of the nail hem. The proximal member 28 includes a plurality of perforations, which typically are horizontally elongate to permit expansion and contraction along the length of panel 10 due to temperature changes.

The distal member 30 of the double-ply nail hem likewise includes a substantially flat span extending downwardly from the curl 32 and terminates in a free edge 34. It is to be understood that the free end of the distal member may include a bead or other formation thereon. As the panel 10 is mounted to the structure, distal member 30 is spaced forwardly away from the proximal member 28 and the structure to provide a span 31 between the proximal and distal members of the double-ply nail hem. Distal member 30 likewise further includes a plurality of perforations axially aligned with the perforation of the proximal member 28. Distal member 30 is formed by folding an elongate nailing strip over on itself, as shown in FIG. 2. Curl 32 thus transitions from the proximal member to the distal member at the uppermost portion of panel 10.

A receiver 18 is integrally formed in the panel 10 immediately below the nail hem to allow adjacent panels to overlap thereby aiding in shedding precipitation. The receiver 18 comprises an interlock 36 projecting outwardly from the panel 10 as mounted on the structure, and curving back upon itself to form an interlock space 38 for receiving the projection 26 of an adjacent panel. The interlock 36 is formed with a first interlock flange 44, which projects generally toward the panel 10 at a lower portion of the interlock and, in a preferred embodiment, further includes a second interlock flange 46 formed at an upper portion of the interlock. Second interlock flange 46 projects slightly toward the panel and preferably extends the longitudinal length of the panel 10.

A first stretch 20 continues downwardly toward the base 24. Preferably, a second stretch 48 is positioned below the first stretch and is staggered below the first stretch 20 by a lap 50. Stretches 20 and 22 are shown in a conventional straight clapboard presentation, but may be provided in other well-known presentations such as Dutch lap or ship lap styles. It is to be understood that a single lap or multi-lap style may be used without departing from the scope of the present invention.

Base 24 is positioned at the lowermost portion of panel 10 and is configured to present a similar appearance to lap 50 as adjacent panels are interlocked and viewed from front side 12. Base 24 includes an elbow 52 and a rearwardly projecting base leg 54. Crook-shaped projection 26 extends upwardly toward nail hem 16 from the base at the rear portion of base leg 54. The projection 26 is operably configured to be complemental with the receiver to permit interlocking of overlapping panels. For such purpose, the crook-shaped projection is accepted into interlock space 38 of the receiver 18 to lock the adjacent panels in proper relation.

Figure 1:
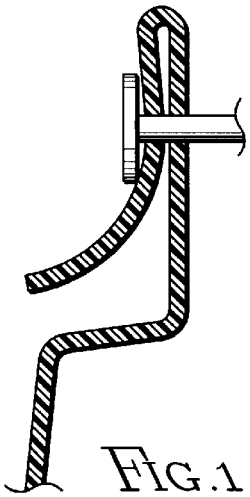
FIG. 1 PRIOR ART
FIG. 1 is a side elevational view of a prior art version of a nail hem.
Figure 3:
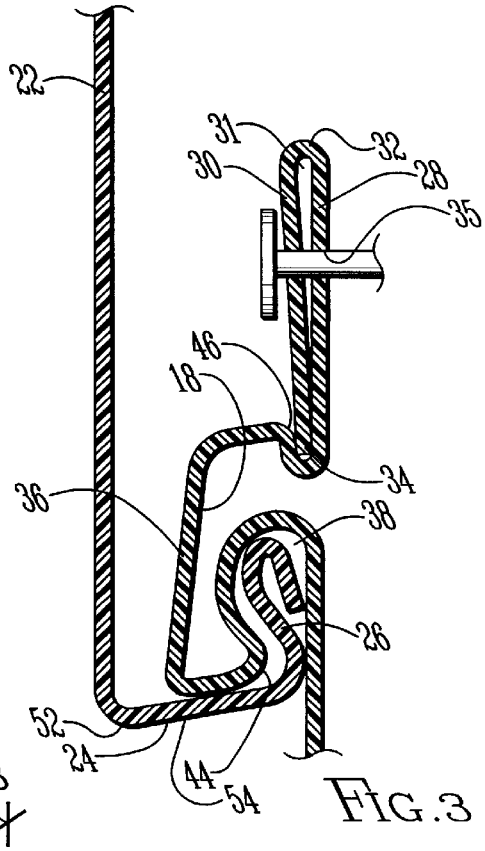
FIG. 3 is a cross-section taken along line 3–3 of FIG. 2 showing the latched double-ply nail hem of the present invention.

In the preferred embodiment, the double-ply nail hem 16 is formed such that free edge 34 of distal member extends to receiver 18 and curl 32 presents a hair pin bend to angle the distal member back toward proximal member, as shown in FIG. 3. As such, free edge 34 bears against the second interlock flange 46, which interferes with the curls tendency to move the distal member outwardly due to thermal expansion or stress relaxation. The interference fit is provided by the second interlock flange 46, which catches at least the free edge of the distal member and thus prevents its movement outwardly. It is to be understood that other interference may be provided on the panel without departing from the scope of the present invention.

In an alternative embodiment, free edge 34 of the distal member 30 may be secured by adhesive or other chemical fastener at its terminating edge against the proximal member 28. As such, free edge 34 is adjoined to the proximal member thereby preventing the tendency of the curl to move the distal member outwardly due to thermal expansion or stress relaxation. In a second alternative embodiment, the free edge 34 is mechanically fastened, such as through the use of a rivet, at several distinct locations along the length of the siding panel to the proximal member thereby interfering with the curls tendency to move the distal member outwardly due to thermal expansion or stress relaxation.

The nail hem is preferably formed such that the span 31 between the proximal member 28 and distal member 30 is approximately 1 mm or. 0.040 in. between the respective apertures of each member. It is to be understood that other spacing may be provided without departing from the scope of the present invention.

In operation, the panel 10 is provided with a latched double-ply nail hem 16, as described hereinbefore. Adjacent panels are fully locked along the length of the bottom by inserting the crook-shaped projection 26 into the interlock space 38 provided in the interlock 36. The panel is mounted to the structure by driving a mounting nail through respective apertures of each distal and proximal member. The mounting nail should not compress the respective members of the nail hem. The mounting nails should be centered in the respective apertures to provide for the thermal expansion of the panel. Proper installation of the mounting nails provide a span 31 for outward movement of panel 10 due to wind load or stress relaxation. Further, second interlock flange maintains free edge 34 of distal member 30 within the second interlock space to prevent the stress relaxation of the curl from loosening the fasteners.

While preferred embodiments of the invention have been shown and described, it will be apparent to those skilled in this art that various modification may be made in these embodiments without departing from the spirit of the present invention. For that reason, the scope of the invention is set forth in the following claims:

What is claimed is:

1. An elongate siding panel for mounting to a support structure and having a front and rear side, said siding panel comprising:

A nail hem for securing said siding panel to the support structure, said nail hem having a proximal member that, as the elongate siding panel is mounted to the support structure, is adjacent to the support structure and a distal member having at least a portion spaced from said proximal member, said distal member terminating in a free end, wherein said proximal member and said distal member are each formed with an aperature therethrough for receiving a fastner through both said proximal member and said distal member; and means for impeding the outward movement of the free end of the distal member.

2. The siding panel of claim 1 wherein the means for impeding the outward movement of the free end comprises a catch projecting outwardly from said panel, said catch forming an impediment for the free end of the distal member thereby preventing further outward movement of the free end of the distal member.

3. The siding panel of claim 2 wherein the catch projecting outwardly from said panel is a receiver formed on said panel, said receiver further forming an interlock for an adjacent panel.

4. The siding panel of claim 3 wherein said receiver includes a flange on an upper portion of said receiver.

5. The siding panel of claim 4 wherein the nail hem and the flange of the receiver extend substantially the longitudinal length of the panel.

6. The siding panel of claim 2 further comprising at least one stretch and a base having a projection operably configured to mate with the receiver for locking adjacent panels.

7. The siding panel of claim 5 wherein the flange of the receiver is operably configured to accept the free end of the distal member.

8. The siding panel of claim 1 wherein the means for impeding the outward movement of the free end comprises an adhesive for adhering the free end to said proximal member to prevent the outward movement of the free end.

9. The siding panel of claim 1 wherein the means for impeding the outward movement of the free end comprises a plurality of mechanical fastners attaching the free end of the distal member to the proximal member thereby preventing further outward movement of the free end of the distal member.

10. The siding panel of claim 1 wherein the means for impeding the outward movement of the free end comprises an adhesive adhering the free end of the distal member to the proximal member thereby preventing further outward movement of the free end of the distal member.

11. A siding panel for mounting to a support structure, comprising:

a) an elongate panel having an upper portion and a spaced apart lower portion;

b) a receiver integrally formed at the upper portion, the receiver comprising an upper interlock flange forming an upper interlock space and a lower interlock flange forming a lower interlock space; and c) a nail hem having a proximal member that, as the elongate panel is mounted to the support structure, is adjacent to the support structure and a distal member having at least a portion spaced from the proximal member, said proximal member and said distal member each being formed with an aperature therethrough for receiving a fastner through both said proximal member and said distal member, wherein said distal member terminating in a free end operably configured to be received in the upper interlock space of the receiver for maintaining the free end.

* * * * *